US011913761B2

(12) United States Patent
Flynn

(10) Patent No.: US 11,913,761 B2
(45) Date of Patent: Feb. 27, 2024

(54) TARGET LABEL ASSEMBLY

(71) Applicant: Timothy J. Flynn, Key Largo, FL (US)

(72) Inventor: Timothy J. Flynn, Key Largo, FL (US)

(73) Assignee: Timothy J. Flynn, Key Largo, FL (US)

( * ) Notice: Subject to any disclaimer, the term of this patent is extended or adjusted under 35 U.S.C. 154(b) by 0 days.

(21) Appl. No.: 17/686,574

(22) Filed: Mar. 4, 2022

(65) Prior Publication Data

US 2022/0268557 A1 Aug. 25, 2022

Related U.S. Application Data

(63) Continuation of application No. 15/054,397, filed on Feb. 26, 2016, now abandoned.

(60) Provisional application No. 62/157,861, filed on May 6, 2015.

(51) Int. Cl.

| | |
|---|---|
| ***F41J 5/00*** | (2006.01) |
| ***F41J 1/00*** | (2006.01) |
| ***F41J 5/14*** | (2006.01) |
| ***F41J 5/20*** | (2006.01) |
| ***F41J 5/24*** | (2006.01) |

(52) U.S. Cl.

CPC . *F41J 5/00* (2013.01); *F41J 1/00* (2013.01); *F41J 5/205* (2013.01); *F41J 5/24* (2013.01); *F41J 5/14* (2013.01)

(58) Field of Classification Search

CPC ..... F41J 5/00; F41J 5/24; F41J 5/205; F41J 1/00; F41J 5/14

See application file for complete search history.

(56) References Cited

U.S. PATENT DOCUMENTS

| | | | |
|---|---|---|---|
| 1,145,585 | A | 7/1915 | Hebard |
| 1,723,826 | A | 8/1929 | Van Auken |
| 1,825,292 | A | 9/1931 | Van Auken |
| 3,330,561 | A | 7/1967 | Kandel |
| 3,353,827 | A | 11/1967 | Dun, Jr. |
| 3,370,852 | A | 2/1968 | Kandel |
| 3,423,092 | A | 1/1969 | Kandel |
| 3,895,803 | A | 7/1975 | Loe |
| 3,899,175 | A | 8/1975 | Loe |
| 4,066,261 | A | 1/1978 | Stewart |

(Continued)

FOREIGN PATENT DOCUMENTS

| | | |
|---|---|---|
| EP | 0 069 668 A2 | 1/1983 |
| GB | 191320060 | 7/1914 |
| UA | 55326 U | 12/2010 |

OTHER PUBLICATIONS

Https://pinkandgreenmama.blogspot.com/2011/05/tolietpaper-tube-craft-target-practice/html, "Pink and Green Mama," May 24, 2011 (4 pages).

*Primary Examiner* — Jeffrey S Vanderveen

(74) *Attorney, Agent, or Firm* — Panley Erickson & Swanson

(57) ABSTRACT

An improved target label for shooting that includes at least one toner layer defining an image of a target, superimposed over a colored substrate having a color different from the toner layer, and an ink layer underlying the toner layer. When a projectile strikes and penetrates the target, the ink and toner layer displaces and scatters over an area surrounding the point of penetration, exposing the underlying colored substrate layer. The scattering of toner particles visually resembles gun powder and visually simulates damage over an area wider than the point of penetration by the projectile.

15 Claims, 5 Drawing Sheets

(56) References Cited

U.S. PATENT DOCUMENTS

| | | | | |
|---|---|---|---|---|
| 4,462,598 | A | 7/1984 | Chalin et al. | |
| 4,498,677 | A | 2/1985 | Dapkus | |
| 4,921,256 | A | 5/1990 | Gearhart | |
| 5,186,468 | A | 2/1993 | Davies | |
| 5,188,371 | A | 2/1993 | Edwards | |
| 5,275,890 | A | 1/1994 | Wolf et al. | |
| 5,501,467 | A | 3/1996 | Kandel | |
| 5,544,881 | A | 8/1996 | Rua, Jr. et al. | |
| 5,580,063 | A | 12/1996 | Edwards | |
| 6,019,375 | A | 2/2000 | West, Jr. | |
| 8,444,056 | B2 | 5/2013 | Gamez et al. | |
| 8,545,226 | B2 | 10/2013 | Norden et al. | |
| 8,556,268 | B2 | 10/2013 | Su | |
| 8,596,643 | B1 * | 12/2013 | Edwards | F41J 5/00 273/378 |
| 8,899,591 | B1 | 12/2014 | Donaldson | |
| 8,984,663 | B2 | 3/2015 | Lee et al. | |
| 9,170,077 | B2 | 10/2015 | Johnson et al. | |
| 9,234,726 | B2 | 1/2016 | Sharrock | |
| 9,625,239 | B2 | 4/2017 | Flynn | |
| 9,857,150 | B1 * | 1/2018 | Larson | F41J 5/24 |
| 10,101,133 | B2 | 10/2018 | Flynn | |
| 2007/0046760 | A1 | 3/2007 | Zara | |
| 2008/0054570 | A1 | 3/2008 | Potterfield et al. | |
| 2009/0058008 | A1 | 3/2009 | Baumgartner et al. | |
| 2009/0166968 | A1 | 7/2009 | Stephens et al. | |
| 2011/0316234 | A1 | 12/2011 | Miller, Sr. | |
| 2014/0284880 | A1 | 9/2014 | Burks | |
| 2016/0327376 | A1 | 11/2016 | Flynn | |
| 2016/0327377 | A1 | 11/2016 | Flynn | |
| 2018/0372457 | A1 | 12/2018 | Flynn | |

* cited by examiner

TARGET LABEL ASSEMBLY

CROSS REFERENCE TO RELATED APPLICATIONS

This application is a continuation patent application of U.S. patent application Ser. No. 15/054,397, filed on 26 Feb. 2016, which claims the benefit of U.S. Provisional Patent Application Ser. No. 62/157,861, filed on 6 May 2015. The Provisional patent application is hereby incorporated by reference herein in its entirety and is made a part hereof, including but not limited to those portions which specifically appear hereinafter.

FIELD OF THE INVENTION

This invention is directed to an improved target for shooting, which, when penetrated by a projectile, exposes one or more different colors over an area surrounding the penetration.

BACKGROUND OF THE INVENTION

Various target labels are known which, upon receiving a projectile, expose an area of color that is larger than the cross-sectional area of the projectile. U.S. Pat. No. 7,631,877, issued to Zara, discloses a target including a substrate, a first ink layer covering at least part of the substrate, and a second ink layer carried by the substrate. The second ink layer includes a first section having a first color and covering at least part of the first ink layer, and a second section having a second color different than the first color. The second ink layer is configured so that the impact of a firearm projectile detaches a portion of the second ink layer from the substrate and exposes a portion of the substrate and/or the first ink layer. In another disclosed embodiment, the target includes a substrate and an ink layer carried by the substrate. The ink layer includes a first section having a first color and a second section having a second color different from the first color. The target is configured so that penetration of a projectile removes a portion of the ink layer and exposes a surface adjacent to the ink layer.

U.S. Pat. No. 3,895,803, issued to Loe, discloses a laminar firearm target including a brightly colored backing sheet, a transparent plastic film bonded to the backing sheet, and a target pattern printed in a black and white ink layer on the front side of the transparent plastic film so as to completely obscure the brightly colored backing sheet. When a projectile strikes the target, a substantially larger than projectile-size portion of the ink layer is removed at the impact point, while a smaller hole is made in the plastic film and backing sheet, exposing an area of the brightly colored backing sheet.

U.S. Publication 2011/0316234 to Miller, Sr. discloses a reactive target for guns that fire non-metallic BB's. The target uses the kinetic energy stored in a plastic BB after it has been launched and transfers that energy into the target mass, causing a colored particulate matter to be expelled into the surrounding area and make a mark on the target surface.

U.S. Pat. No. 5,275,890 to Wolf et al. discloses a gun target including substantially planar first and second sheets. The first sheet has a back surface and an exposed front surface which carries a graphic pattern having a first color, at which the weapon is aimed. The second sheet is connected to the back surface of the first sheet and has a contrasting color relative to the first color. When a round fired from the weapon into the graphic pattern penetrates both sheets, the resulting hole exposes the second color at the front surface of the first sheet.

The foregoing targets all have the ability to expose a colored area around the hole made by the projectile, to amplify the visual impact when the target is hit. In the competitive field of target labels, there is a need or desire for cost-efficient target labels that further enhance the visual impact when the target is hit.

SUMMARY OF THE INVENTION

The present invention is directed to an improved target label that uses toner instead of, or printed on a layer of, ink to define a target image, and may also use toner to form an underlying colored layer. In contrast to ink, toner is predominantly a powder, and is used in laser printers and photocopiers to form the text and images on printed paper. The primary components of toner are a powdered polymer such as styrene-acrylate copolymer, polyester, or styrene-butadiene copolymer, sometimes blended with carbon black and/or iron oxide powder. Various toner colors can be synthesized by blending the polymer with a pigment before forming the powder. Toner can be prepared by compounding the ingredients and forming a slab, which is then pulverized to the desired particle size. Toner powder can have a particle size ranging from about 16 micrometers down to about 8-10 micrometers or less.

In conventional applications, toner particles are melted by heat, causing them to individually bond to the underlying material. In embodiments of this invention, another technique is to mix the toner powder with an aqueous carrier to form liquid toner. The liquid toner is applied at room temperature and dried, resulting in minimal adhesion of the toner to the underlying layer. This promotes scattering of the toner powder when the target is struck by a firearm projectile. The liquid toner may include about 20-80% by weight toner powder and about 20-80% by weight of the aqueous carrier, suitably about 30-70% by weight toner powder and about 30-70% by weight of the aqueous carrier.

Ink, by contrast, is a liquid or paste that contains pigments or dyes carried by a solvent. Ink strongly adheres to the substrate upon drying the solvent. Ink can be a complex medium of solvents, pigments, dyes, resins, lubricants, solubilizers, surfactants, particulate matter, and fluorescents. As used herein, the terms "toner" and "ink" are mutually exclusive of each other.

In one embodiment, the invention is directed to a target that includes a colored substrate including at least one paper or plastic layer and having a first color. A transparent plastic film overlays a front surface of the colored substrate. An opaque ink layer overlays a front surface of the transparent plastic film A toner layer, defining an image of a target, overlays the opaque ink layer, and has a second color different from the first color. The opaque ink layer can have a third color that is different from the first color and the second color. The opaque ink layer can be white, and hides the first color. The opaque ink layer acts as a release layer or agent that is partially removable from the plastic film upon an impact from a projectile to reveal the first color, thereby making the impact more noticeable from afar.

In one embodiment, the invention provides a target that has a colored substrate including at least one paper or plastic layer and having a first color, the colored substrate having a front surface and a back surface. The target further includes a transparent plastic film having a front surface and a back surface, where the back surface of the transparent plastic film overlays the front surface of the colored substrate. An opaque layer of ink overlays the front surface of the transparent plastic film and masks the first color under the ink. A toner layer defining an image of a target overlays the opaque ink layer. The opaque layer is visible about a periphery of the image of the target and the toner layer has a second color different from the first color.

Because the toner layer is formed of discrete particles, suitably with minimal adhesion when applied via an ink release layer, they can have improved scattering properties when the target is hit, causing the visual appearance of gun powder burns surrounding the area of the target penetrated by a projectile, in addition to exposing underlying colored layer(s). The exposure of one or more underlying colors, combined with the visual appearance of powder burns, enhances the enjoyment of using the target labels for target practice.

DETAILED DESCRIPTION OF THE INVENTION

Figure 1:
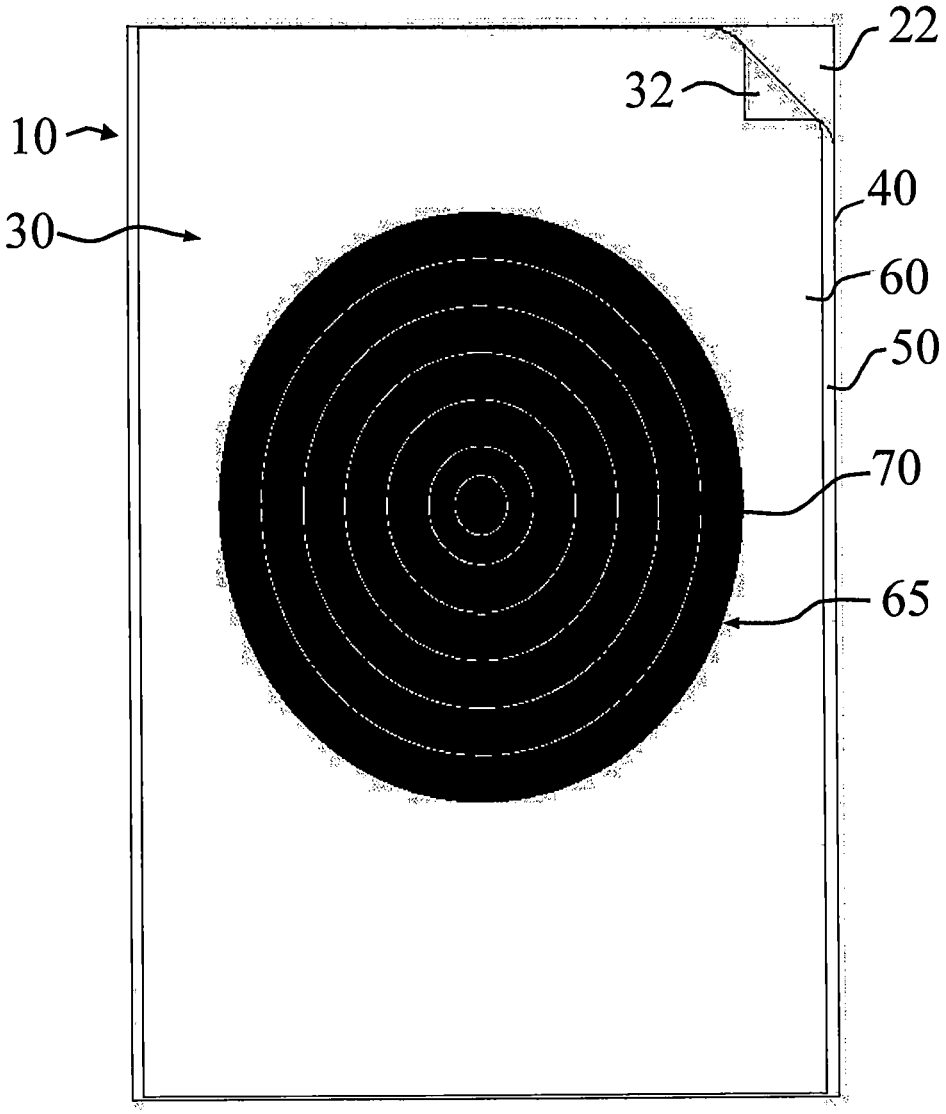
FIG. 1 is a plan view of a target label according to one embodiment of the invention, showing the front of the target label with an upper corner being peeled from a liner.
Figure 2:
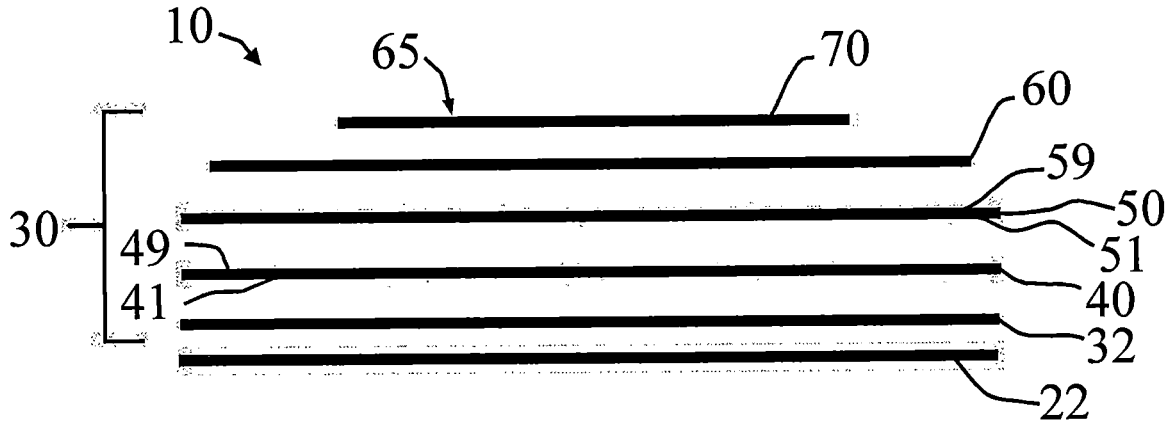
FIG. 2 is an exploded side view of the target label of FIG. 1, showing the individual layers.

Referring to FIGS. 1 and 2, a target label assembly 10 includes a liner 22 and a target label 30. The liner 22 is initially releasably joined to the target label 30 and is peeled away (see the upper right corner) when the target label 30 is ready for mounting to a mounting board or other device (not shown). The releasable liner 22 can be formed of paper, polymer-coated paper, polyester film, high density polyethylene film, low density polyethylene film, biaxially oriented polypropylene, and a wide variety of polymers and polymer combinations. Suitable paper liners include without limitation super calendared kraft paper with or without a polyvinyl alcohol coating, clay coated kraft paper, machine finished kraft paper, and machine glazed kraft paper. Any suitable sizing or release agents can be incorporated as needed to make the liner removable from a pressure sensitize adhesive material 32 layer of the target label 30.

The target label of FIG. 1 includes a pigmented or colored substrate 40. The pigmented substrate 40 can be a single layer of paper or plastic film, or can include additional layers, such as described below. The layer 40 is desirably a colored paper or plastic film having a first color imparted by dyeing or otherwise impregnating the paper or plastic film during its manufacture or by other suitable methods, and does not require or include application of an ink layer. The colored substrate 40 can be devoid of ink layers. The color is desirably a bright, noticeable color, such as yellow or orange, or a fluorescent color. The paper layer can be selected from a wide variety of commercially available colored papers that have suitable thickness and integrity to serve as a substrate for a target label. When a colored plastic is used for substrate 40, the plastic can be selected from low density polyethylene, linear low density polyethylene, polypropylene, polyester, polyamide, and a wide variety of other polymers having suitable integrity at the desired thickness.

The colored substrate 40 has a back surface 41 and a front surface 49, with the first color visible from at least the front surface 49. The laminate target 30 of FIG. 1 includes a transparent film 50 having a back surface 51 and a front surface 59. The back surface 51 of the transparent film 50 can be joined to the front surface 49 of the colored substrate 40 by any suitable method, such as by using an pressure sensitive or other adhesive, by extrusion onto the substrate 40, by heat sensitive film, or by crosslinking or vulcanization directly to the substrate 40.

The transparent film 50 is suitably made of plastic, and can contain one or multiple layers. The plastic film layer(s) can be any transparent polymer material that allows the substrate 40 first color to be perceived there through. Exemplary polymers include, without limitation, biaxially oriented polypropylene, linear low density polyethylene, ethylene vinyl acetate, polyethylene terephthalate, polybutylene terephthalate, polyamide, acrylic copolymers, and the like. In one embodiment of this invention, the film 50 desirably covers at least substantially all of the substrate surface 49. An adhesive material for attaching the film 50 to the substrate 40 can be selected from a wide variety of suitable adhesives, including without limitation solvent-based adhesives based on polyamide suspensions, polyacrylates, polyurethanes and the like, as well as extrudable polyolefin-based adhesives and ionomers having reactive functional groups. The adhesive layer can optionally contain particles or flakes of glitter, as described above, provided that the concentration of glitter particles or flakes is not so high as to obscure the first color on the front surface 49 of colored substrate 40. Any suitable surface 59 treatment can be used to provide improved release functionality, such as described below.

The target label 10 includes at least one release layer 60 overlaying the front surface 59 of transparent film 50. The release layer 60 facilitates separation from the transparent film 50. In embodiments of this invention, the release layer is an opaque ink layer 60 overlaying the front surface 59 of the transparent plastic film 50. The opaque ink layer 60 has an opacity to cover, mask, or otherwise hide the first color of the substrate 40. The opaque ink can be any suitable ink, such as an oil-based ink, an aqueous ink, or a vegetable-based ink. The opaque ink layer 60 has a color that is different from the first color of the substrate 40, such as a white ink layer 40 covering a yellow substrate 40.

The ink layer 60 forms a surface on which a target image 65 is applied. In embodiments of this invention, the target image 65 is formed of a toner layer 70, and can be any suitable shape or silhouette. The toner is pigmented with a different color from each of the ink layer 60 and first color of the substrate 40. Preferred embodiments use a black or dark gray, navy, or green, etc. to stand out against the light-colored ink, and also providing contrast to the lighter, brighter color of the substrate 40.

In conventional applications, toner particles are melted by heat, causing them to individually bond to the underlying material. In embodiments of this invention, the toner layer 70 can be applied as a dry or wet toner, and then dried or otherwise thermally activated to adhere the powder toner particles to the ink layer 60. The target image 65 can be applied during manufacture of the target label 30, or can be printed by a home or commercial consumer, on the ink layer by a suitable consumer printer.

Figure 3:
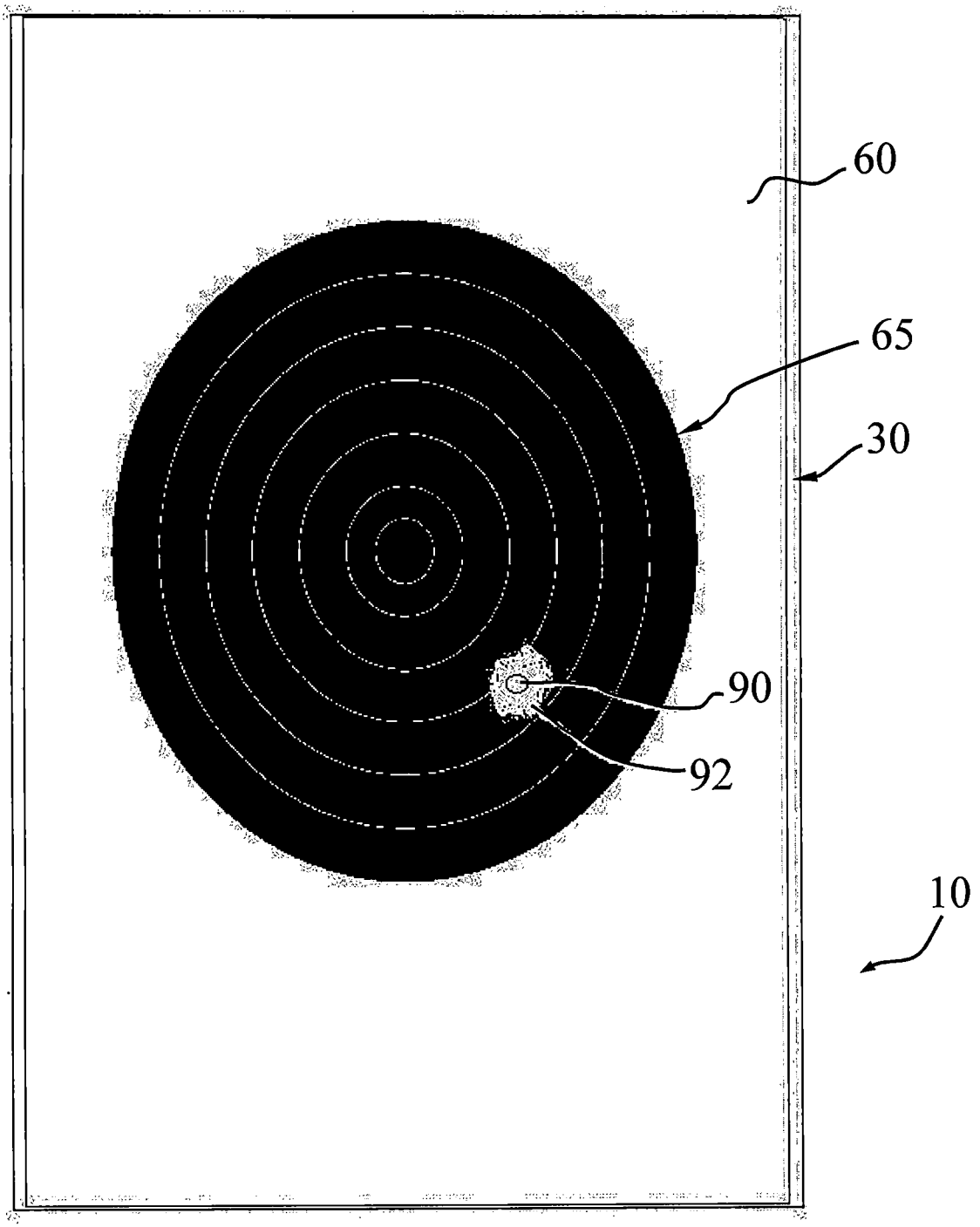
FIG. 3 illustrates one embodiment of the target label, after it has been penetrated by a projectile.

During use, the liner 22 is removed from the target label 30 to expose the pressure-sensitive adhesive 32, which is used to secure the target label 30 to a mounting surface or device. In an alternative embodiment, the adhesive 32 and liner 22 are not needed, and the substrate can be attached or hung by other suitable means, such as fasteners or clips, to a target stand. FIG. 3 illustrates a target label 10 after the target has been penetrated by a projectile, leaving a projectile opening 90. By operation of the release ink layer 60 between the transparent film 50 and the toner layer 70, an area 92 of the ink layer 60 and the toner layer 70 is displaced which exceeds the diameter of the projectile opening 90. The contrasting first color of the front surface 49 of colored substrate 40 is exposed over the area 92, creating the visual impression of enhanced damage when the projectile hits the target label 30. The scattering of the ink layer 60 and/or the toner layer 70 to uncover area 92 also contributes to a visual simulation of gun powder burns in the area 92.

Figure 4:
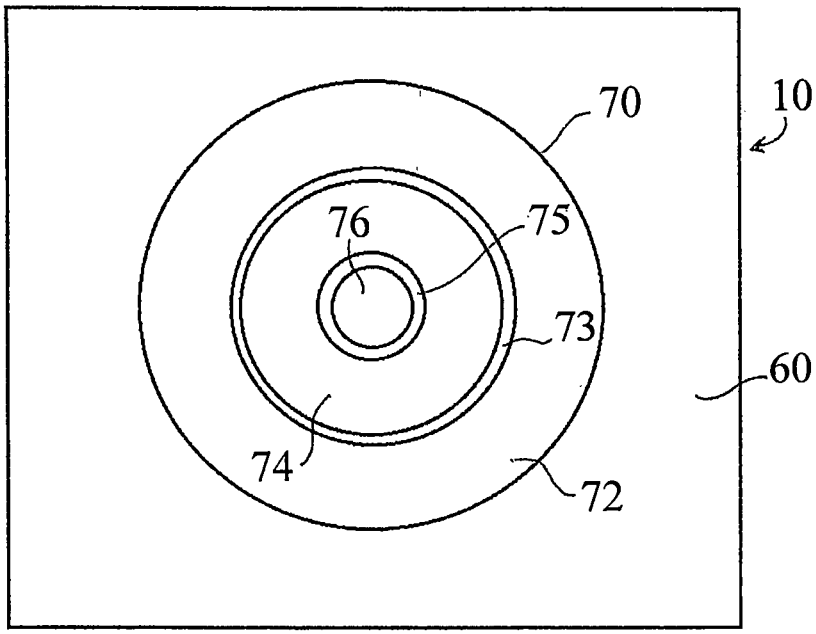
FIG. 4 is a plan view of a target label according to one embodiment of the invention, showing the front of the target label.
Figure 5:
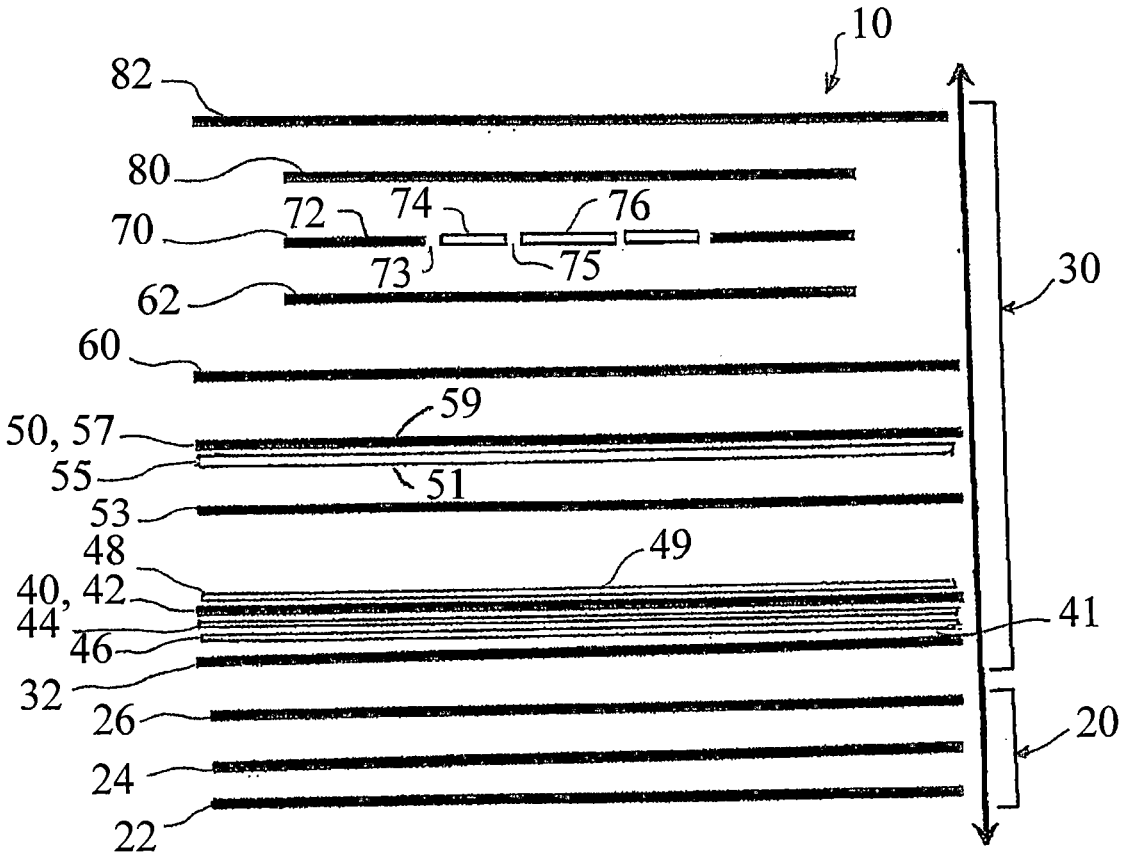
FIG. 5 is an exploded side view of the target label of FIG. 4, showing the individual layers, and showing overlaying layers of clear coating or varnish.

Referring to FIGS. 4 and 5, a target label assembly 10 includes a liner assembly 20 and a target label 30. The liner assembly 20 is initially releasably joined to the target label 30 and is peeled away when the target label 30 is ready for mounting to a mounting board or other device (not shown). The liner assembly 20 includes a paper or film liner 22, a sizing coating 24, and a release agent which can be incorporated into the sizing coating or applied as a separate release layer 26.

The liner assembly 20 includes a paper or film liner 22, such as described above, and is shown including a sizing coating 24, and a release agent which can be incorporated into the sizing coating or applied as a separate release layer 26. The coating layer 24, which can also serve as a release layer, can be formed of silicone, polytetrafluoroethylene, polyethylene terephthalate, polyamide, polyacrylonitrile, or the like. When the coating layer 24 does not have sufficient release properties, a separate release layer 26 formed of silicone or another suitable release material can be included.

During use, the release assembly 20 is removed from the target label 30 to expose a pressure-sensitive adhesive layer 32, used to secure the target label 30 to a mounting device. The target label 30 includes a colored substrate 40 having a first color. The colored substrate 40 can be a single layer 42 of paper or plastic film, or can include additional layers, such as the illustrated layers 44, 46 and 48. The layer 42 can be a colored paper or plastic film having the first color imparted by dyeing or otherwise pigmenting the paper or plastic film during its manufacture, and does not require application of an ink layer. The colored substrate 40 can again be devoid of ink layers. The paper layer can be selected from a wide variety of commercially available colored papers that have suitable thickness and integrity to serve as a substrate for a target label. When a colored plastic is used for layer 42, the plastic can be selected from low density polyethylene, linear low density polyethylene, polypropylene, polyester, polyamide, and a wide variety of other polymers having suitable integrity at the desired thickness.

In alternative embodiments, the colored substrate 40 may include additional layers, such as the illustrated layers 44, 46 and 48. In one embodiment, the layers 44 and 46 can be colored paper or plastic layers, or both, having colors that are different from each other and different from the first color of layer 42. When multiple substrate layers with different colors are used, the layers can be designed so that when a projectile hits the target, a "starburst" or "halo" of multiple colors is observed around the point of impact, as described below with respect to FIG. 7. The colored substrate layers 42, 44 and 46 can be any combination of colored paper layers, colored plastic layers, or both, as further described below.

In another embodiment, the layers 42 and 46 can be colored paper and/or plastic layers, having different colors. The intervening layer 44 can be an adhesive layer designed to facilitate separation between layers 42 and 46 in the region of impact when a projectile penetrates the target label 30. The layer 44 can be any suitable adhesive, and can incorporate a release agent, such as a silicone release agent. The release agent can be used to control the adhesion between layers 42 and 46, and can facilitate localized separation between layers 42 and 46 when a projectile penetrates the target label 10. Suitable adhesives include without limitation solvent-based adhesives based on polyamide suspensions, polyacrylates, polyurethanes and the like, as well as extrudable polyolefin-based adhesives and ionomers having reactive functional groups.

In one embodiment, the layer 44 can incorporate a finely dispersed glitter. Glitter particles can be formed of aluminum, mica, malachite or the like, or can be formed of pigmented plastic flakes. The use of glitter particles provides a sparkling effect, thus enhancing the "starburst" or "halo" when a projectile penetrates the target 10.

The optional layer 48 of substrate 40 (shown above layer 42) can similarly be a layer of glitter, or an adhesive layer that contains glitter particles. The layer 48 can also be a layer of toner having a color different from the color of layer 42, or can be a layer of toner mixed with glitter. If the layer 48 is a toner layer, then the toner color will be the first (front-facing) color of the colored substrate 10. The layer 48 can also be combined with a release agent, such as a silicone release agent, that facilitates separation from the underlying colored layer 42 around the region of impact, when a projectile penetrates the target 10. When the layer 48 includes toner and/or glitter, the toner and/or glitter particles can scatter around the region surrounding the penetration by the projectile, simulating the visual appearance of gun powder.

The colored substrate 40 has a back surface 41 and a front surface 49, with the first color visible from the front surface 49. The laminate 30 may further include a transparent film 50 having a back surface 51 and a front surface 59. The back surface 51 of the transparent film 50 can be joined to the front surface 49 of the colored substrate 40 using an adhesive layer 53.

The transparent film 50 is suitably made of plastic, and can contain multiple layers, illustrated as layers 55 and 57. The plastic film layer(s) can be any transparent polymer material, including without limitation biaxially oriented polypropylene, linear low density polyethylene, ethylene vinyl acetate, polyethylene terephthalate, polybutylene terephthalate, polyamide, acrylic copolymers, and the like. The adhesive layer 53 can be selected from a wide variety of suitable adhesives, including without limitation solvent-based adhesives based on polyamide suspensions, polyacrylates, polyurethanes and the like, as well as extrudable polyolefin-based adhesives and ionomers having reactive functional groups. The adhesive layer 53 can optionally contain particles or flakes of glitter, as described above, provided that the concentration of glitter particles or flakes is not so high as to obscure the first color on the front surface 49 of colored substrate 40.

The target label 10 includes at least one release layer or agent 60 overlaying the front surface 59 of transparent film 50. In the embodiment shown, a second release layer 62 separates the first release layer or agent 60 from the toner layer 70, which defines an image of a target. The first release layer or agent 60 facilitates separation from the transparent film 50 and can be formed of or include polytetrafluoroethylene, polyester, polyamide, polyacrylonitrile, or a silicone polymer. The second release layer 62 facilitates separation of the toner layer 70 and is suitably an ink layer as described above or a silicone polymer or a release agent that includes a silicone polymer. The first release layer 60 can also be designed to facilitate release from both the transparent film 50 and the toner layer 70, by incorporating a release agent or agents (e.g. a silicone release agent) that is suitable for both purposes, in which case the second release layer 62 may not be needed.

In one embodiment, the release layers 60 and/or 62 may not be needed. The adhesion of toner layer 70 to transparent film 50 or an intermediate ink layer can be optimized to facilitate separation of the toner layer 70 using other techniques, including without limitation optimizing the surface tension of the front surface 59 of transparent film 50 by proper material selection, corona treatment to impart an electrostatic charge, and/or applying the toner using an aqueous carrier as described above. Regardless of the technique, the objective is to strike a suitable balance between adhesion and release that enables the toner layer 70 to remain intact until the target label 30 is struck by a firearm projectile, at which time the ink and/or toner particles scatter outward from the region of impact.

The toner layer 70 defines the shape of a target. As shown in FIGS. 4 and 5, the toner layer 70 can have a first section 72 having a second color different from the first color, a second section 74 having a third color different from the first and second colors, and a third section 76 having a fourth color different from the first, second and third colors. The first and second sections 72 and 74 are separated by at least one gap 73. The second and third sections 74 and 76 are separated by at least one gap 75. The first color of the front surface 49 of colored substrate 40 can be viewed through the gaps 73 and 75. If the colored substrate 40 has multiple layers with different colors, then it is desirable for the first, second, third and fourth colors to be different from each other and from each of the multiple layers of the colored substrate 40.

The toner layer 70 can be applied as a single layer having multiple colors as shown. Alternatively, the toner layer 70 can include multiple layers of toner to create the desired target design. The toner layer 70 can optionally be overlaid with one or more layers 80 and 82 of clear coating or varnish, shown only in FIG. 5. Clear coatings and varnishes are conventional. Any suitable clear coatings and varnishes can be used.

Figure 6:
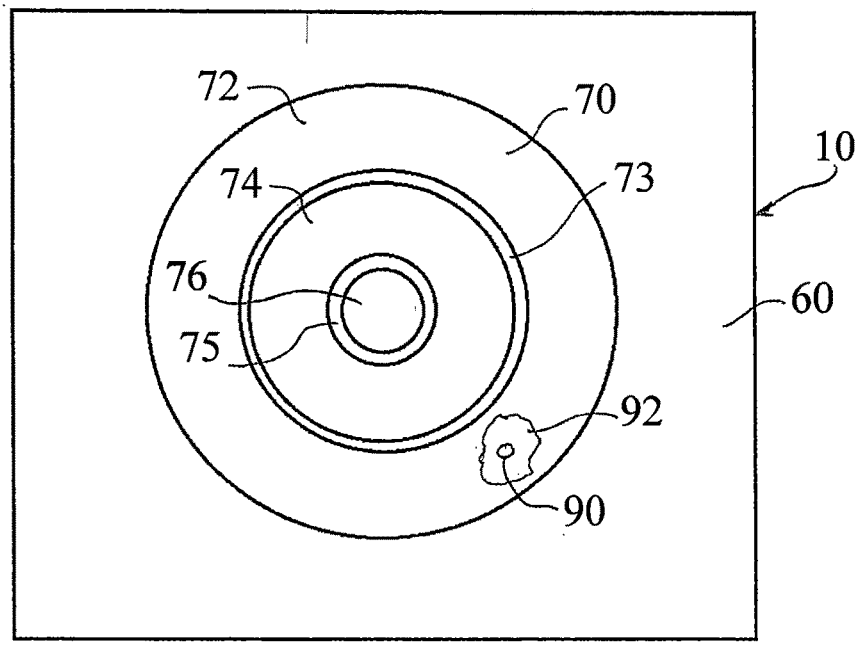
FIG. 6 illustrates one embodiment of the target label, after it has been penetrated by a projectile.

FIG. 6 illustrates a target label 10 after the target has been penetrated by a projectile, leaving a projectile opening 90. In this embodiment, the colored substrate 40 may have only one colored paper or plastic film layer 42. By operation of the release layer(s) 60 and/or 62 between the transparent film 50 and the toner layer 70, an area 92 of toner layer 70 is displaced which exceeds the diameter of the projectile opening 90. The contrasting first color of the front surface 49 of colored substrate 40 is exposed over the area 92, creating the visual impression of enhanced damage when the projectile hits the target label 70. The scattering of toner layer 70 over area 92 also contributes to a visual simulation of gun powder burns in the area 92.

Figure 7:
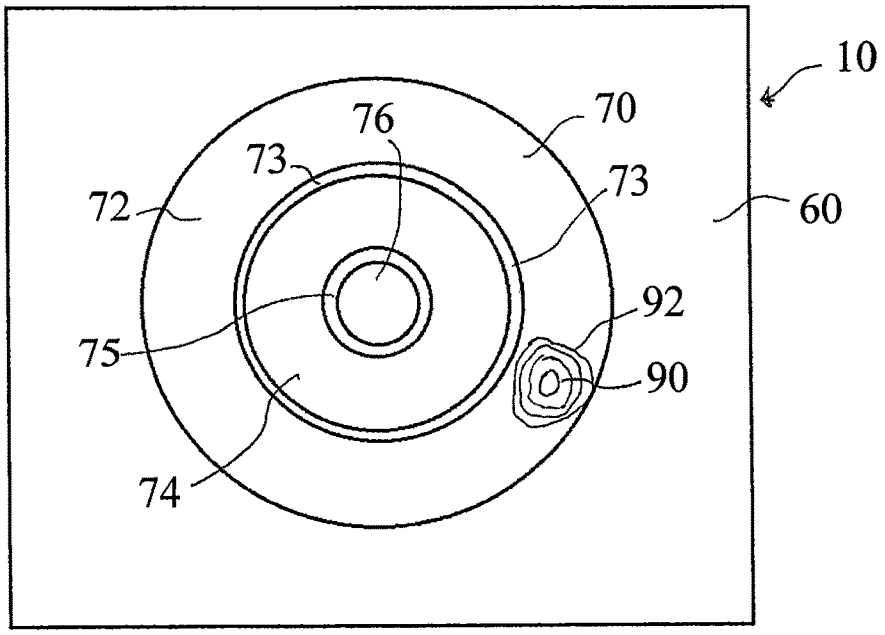
FIG. 7 illustrates another embodiment of the target label, after it has been penetrated by a projectile.

FIG. 7 illustrates a more complicated target label 10 after the target has been struck and penetrated by a projectile. In this embodiment, the colored substrate 40 may have multiple colored layers 42, 44, 46 and/or 48 as described above, with appropriate release agents existing in or between some of the layers, and/or with glitter particles or flakes present in one or more layers. In this embodiment, the area 92 has a multi-colored "starburst" or "halo" image. The precise image will, of course, vary depending on how many substrate layers are colored and/or contain glitter, the specific materials used for the colored layers, the specific colors, and the release properties between the colored layers. The layers can be specifically designed so that the toner layer 70 displaces over the entire area 90, and the underlying substrate layers of color and/or glitter displace over progressively smaller areas. This requires proper selection of layer thickness, layer materials, adhesive(s) and release properties between the layers.

Variations of the embodiments described above are also contemplated by the invention. In the simplest embodiment, the transparent film 50 can be eliminated and the toner layer 70 can be applied over the colored substrate 40, with appropriate release layer(s) or release agent(s) underlying the ink layer and/or the toner layer 70. In another embodiment, a release agent can be included within the ink layer and/or the toner layer 70, alleviating the need for a separate underlying release layer. The colored substrate 40, as described above, is suitably devoid of ink layers. As an alternative, one or more layers of the colored substrate 40 can be formed by applying an ink layer on an underlying paper or plastic film layer, and/or by including a release agent within the ink layer. Other variations are also possible.

Figure 8:
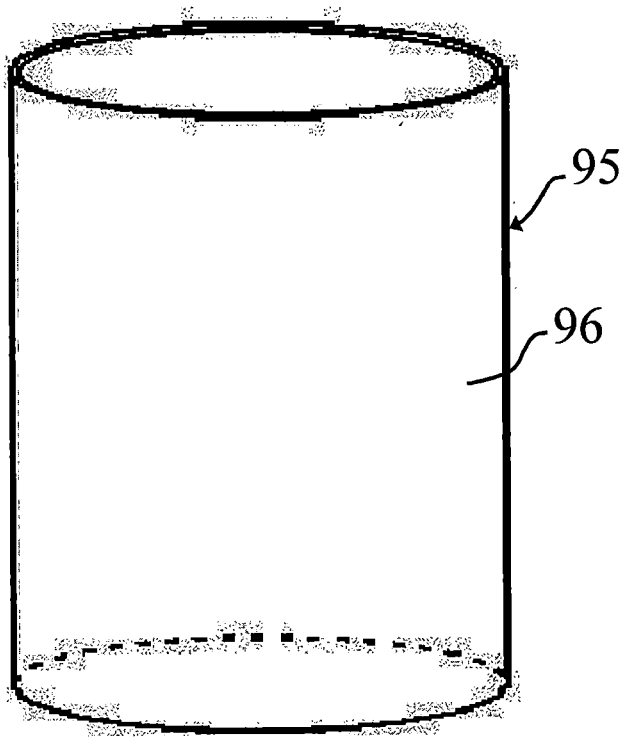
FIG. 8 is a perspective view of a target structure according to one embodiment of the invention.
Figure 9:
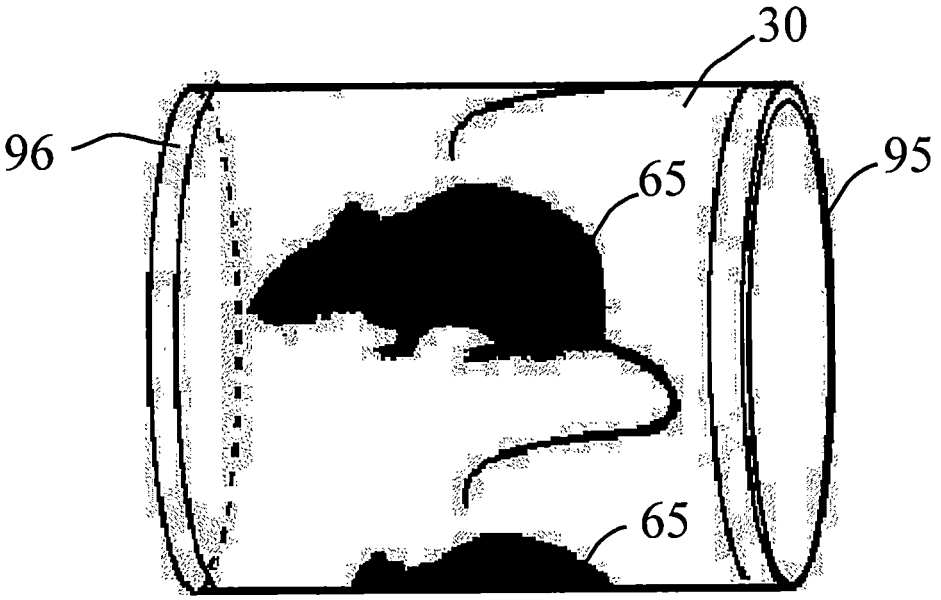
FIG. 9 is a perspective view of a target structure according to FIG. 8 including a target label according to one embodiment of the invention.

The targets of this invention can be any suitable size and secured to any suitable target structure or backstop, such as are commercially available. The target can be adhered directly to a surface of a target structure as a self-adhesive label, or can be hung within a target structure in the same manner as current non-adhesive paper targets. FIG. 8 illustrates a target structure according to one embodiment of this invention. FIG. 8 is a hollow, cylindrical cardboard tube formed of a suitable cardboard thickness to withstand being shot while providing projectile holes as described above. The tube structure can be held in any suitable manner in a horizontal or vertical orientation. FIG. 9 shows a target label 30 according to one embodiment of this invention, and having several target images 65 printed thereon, adhered around an outer surface 96 of the cylindrical tube. The cardboard structure can alternatively be any suitable size, shape, or configuration, such as a rectangular box having a printed toner label image corresponding to each side of the box.

The embodiments of the invention described herein are presently preferred. Various modifications and improvements can be made without departing from the spirit and scope of the invention. The scope of the invention is defined by the appended claims, and all changes that fall within the meaning and range of equivalents are intended to be embraced therein.

I claim:

1. A target, comprising:

a colored substrate including at least one paper or plastic layer and having a first color, the colored substrate having a front surface and a back surface;

a transparent plastic film having a front surface and a back surface, the back surface of the transparent plastic film overlaying the front surface of the colored substrate;

a toner layer defining an image of a target, overlaying and adhered directly to the front surface of the transparent plastic film, and having a second color different from the first color; and a clear coating applied over the toner layer and any exposed area of the opaque ink layer.

2. The target of claim 1, wherein the toner layer hides the first color.

3. The target of claim 2, wherein the toner layer is removable upon an impact to reveal the first color.

4. The target of claim 1, wherein the clear coating comprises a varnish.

5. The target of claim 1, wherein the colored substrate comprises an adhesive material on a side opposite the plastic film.

6. The target of claim 5, further comprising a release liner over the adhesive material.

7. The target of claim 1, further comprising a release liner covering the back surface of the colored substrate and a releasable adhesive joining the release liner to the back surface of the colored substrate.

8. The target of claim 1, further comprising an adhesive material joining the front surface of the colored substrate to the back surface of the transparent film.

9. A target, comprising:

a colored substrate including at least one paper or plastic layer and having a first color, the colored substrate having a front surface and a back surface;

a transparent plastic film having a front surface and a back surface, the back surface of the transparent plastic film overlaying the front surface of the colored substrate;

a release agent directly overlaying the front surface of the transparent plastic film, the release agent selected from the group consisting of polytetrafluoroethylene, polyester, polyamide, polyacrylonitrile, and a silicone polymer;

a toner layer defining an image of a target and printed directly on the release agent wherein the toner layer has a second color different from the first color; and a clear coating applied onto and over the toner layer and the visible opaque layer.

10. The target of claim 9, wherein the toner layer is removable upon an impact to reveal the first color.

11. The target of claim 9, wherein the toner layer is thermally activated to adhere to the release coating.

12. The target of claim 9, wherein the colored substrate comprises an adhesive material on a side opposite the plastic film.

13. The target of claim 12, further comprising a release liner over the adhesive material.

14. The target of claim 9, further comprising a release liner covering the back surface of the colored substrate and a releasable adhesive joining the release liner to the back surface of the colored substrate.

15. The target of claim 9, further comprising an adhesive material joining the front surface of the colored substrate to the back surface of the transparent film.

* * * * *